US007146782B2

(12) United States Patent
Pantelleria et al.

(10) Patent No.: US 7,146,782 B2
(45) Date of Patent: Dec. 12, 2006

(54) METHOD OF SEALING A PLUG WITH A FOOD SAUCE DISPENSING CARTRIDGE

(75) Inventors: Joseph A. Pantelleria, Overland Park, KS (US); Ernie L. Smith, Kansas City, MO (US)

(73) Assignee: Huhtamaki Consumer Packaging, Inc., Desoto, KS (US)

( * ) Notice: Subject to any disclaimer, the term of this patent is extended or adjusted under 35 U.S.C. 154(b) by 395 days.

(21) Appl. No.: 10/643,658

(22) Filed: Aug. 19, 2003

(65) Prior Publication Data

US 2005/0072809 A1 Apr. 7, 2005

(51) Int. Cl.
*B65B 7/28* (2006.01)
*G01F 11/06* (2006.01)

(52) U.S. Cl. ..... 53/489; 53/471; 156/293; 222/327

(58) Field of Classification Search ..... 53/489, 53/486, 471, 330, 264, 319, 329.2; 156/293, 156/294; 222/327, 620, 391, 387, 490, 105
See application file for complete search history.

(56) References Cited

U.S. PATENT DOCUMENTS 2,106,577 A * 1/1938 Sherbondy ..... 222/391
3,884,396 A * 5/1975 Gordon et al. ..... 222/327
4,135,347 A * 1/1979 Lowdermilk ..... 53/574
4,432,473 A * 2/1984 MacEwen ..... 222/327
4,493,860 A * 1/1985 Callahan ..... 427/230
4,830,231 A * 5/1989 Smith ..... 222/327
6,361,485 B1 3/2002 Robertson
6,371,335 B1 4/2002 MacEwen

* cited by examiner

*Primary Examiner*—Louis K. Huynh
*Assistant Examiner*—Thanh Truong
(74) *Attorney, Agent, or Firm*—Blackwell Sanders Peper Martin LLP

(57) ABSTRACT

A method of sealing a plug with a food sauce dispensing cartridge enables leak proof operation of the dispensing cartridge at the site of the plug. The plug, having a circumferential edge, is positioned within the dispensing cartridge and oriented such that the edge is adjacent to the cartridge sidewall. A layer of hot melt adhesive is then applied to the circumferential edge and flows into a gap created between the plug and the cartridge sidewall at a sideseam formed by an overlap region of the cartridge sidewall. The hot melt adhesive subsequently bonds the plug to the cartridge sidewall and prevents food sauce from moving past the circumferential edge of the plug and out of a containment region.

12 Claims, 1 Drawing Sheet

METHOD OF SEALING A PLUG WITH A FOOD SAUCE DISPENSING CARTRIDGE

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

Food sauce dispensing cartridges are used throughout the food service industry for dispensing a measured quantity of sauce on a food item. As an example, in fast service restaurants, a large volume of food items must be prepared for customers in a relatively short around of time. Meeting this demand presents a significant challenge; consistent food quality can only be achieved by dispensing the correct amount of sauce, but the fast pace of preparing food items leaves little time to carefully measure dispensed amounts. The use of handheld dispensing guns with food sauce dispensing cartridges has enabled consistent and fast dispensing of sauce amounts to allow greater quantities of food items to be prepared within a narrow timeframe. The exact quantity of sauce dispensed by the cartridge is controlled by valves formed in the dispensing end of the cartridge and the degree of motion of the dispensing gun acting on a plug in the cartridge being advanced towards the dispensing end. Each time a trigger of the dispensing gun is pulled, the gun advances the plug a consistent distance.

Typically, food sauce dispensing cartridges are fabricated from paper stock with opposing ends folded together in a continuous loop sidewall such that the ends overlap one another and are adhered together to form the cartridge in a cylindrical shape. This overlap creates a sideseam that runs the length of the container. Additionally, the outer and interior surfaces of the cartridge are typically coated with a thermoplastic liner. The plug is most often formed of a thermoplastic or other similar plastic.

While advancements have been made in the design and manufacture of end caps containing the values disposed at the dispensing end of the dispensing cartridges, problems remain with methods of sealing the plug with the cartridge to prevent leaks at the plug. Although plugs are often bonded with the interior surface of the dispensing cartridge before use with a dispensing gun, the bond must release enough to allow the gun to advance the plug through the cartridge while at the same time maintaining a seal such that food sauce within the cartridge may not pass by the peripheral edge of the plug and escape out of the containment region. One common method of bonding the plug is to heat the flanged perimeter edge of the plug (e.g., with hot air) such that the plastic melts and bonds with the thermoplastic liner of the cartridge. This method, however, does not provide a leak proof seal for typical dispensing cartridges. This is because the internal sideseam of the cartridge causes the interior diameter thereof to vary as much as the sidewall thickness of the container from a point where the sidewall overlap occurs to a point adjacent to the sideseam. The plug on the other hand has a consistent diameter around the peripheral edge, and the melting of the flanged edge is not sufficient to fill a gap created between the peripheral edge and the cartridge sidewall at a point immediately adjacent to the sideseam. Thus, as the dispensing gun advances the plug, food sauce escapes the cartridge not only at the intended dispending end, but also by bypassing the periphery of the plug along the sideseam towards the opposing end. Also, the gap may present an additional path for contaminants to enter the containment region of the cartridge.

BRIEF SUMMARY OF THE INVENTION

In light of the aforementioned problems, the present invention provides an improved method of sealing a plug with a food sauce-dispensing container whereby leakage in the plunging region is eliminated. A plug with a body and a peripheral skirt is first positioned within a plunging end of a dispensing container such that the circumferential edge of the plug on the peripheral skirt is aligned generally in a plane perpendicular to the longitudinal axis of the container. The plug is generally sized with a diameter about the same as the average diameter of the dispensing container so that it may be frictionally fit therein, leaving a gap between the circumferential edge of the plug and the container sidewall adjacent to the container sideseam. Subsequently, a layer or bead of hot melt adhesive is applied to the circumferential edge of the plug to bond the plug with the dispensing container sidewall. The adhesive also flows into the gap between the plug and the container to prevent food sauce disposed in a containment region between the plug and an end disk at the dispensing end of the container from escaping around the periphery of the plug. The bonding or sealing of the plug may take place before the end disk is connected to the dispensing container, or preferably, is done at the last step of dispensing container construction after end disk connection is complete.

With the method of dispensing container construction taught by the present invention, less food sauce product is wasted and there is less risk of food contamination because the open channel or gap to the containment region around the plug is eliminated. In use, as the user pulls the trigger on the dispensing gun to advance the plug, the pressure within the containment region between the plug and the end disk will increase. Because the plug is bonded to the container sidewall using the hot melt adhesive which fills the gap created at the sideseam, the plug seal can withstand the pressure increase without failing so that the food sauce is only dispensed properly out of the valves in the end disk.

BRIEF DESCRIPTION OF THE SEVERAL VIEWS OF THE DRAWING

In the accompanying drawings which form a part of the specification and are to be read in conjunction therewith and in which like references numerals are used to indicated like parts in the various views.

DETAILED DESCRIPTION OF THE INVENTION

Figure 1:
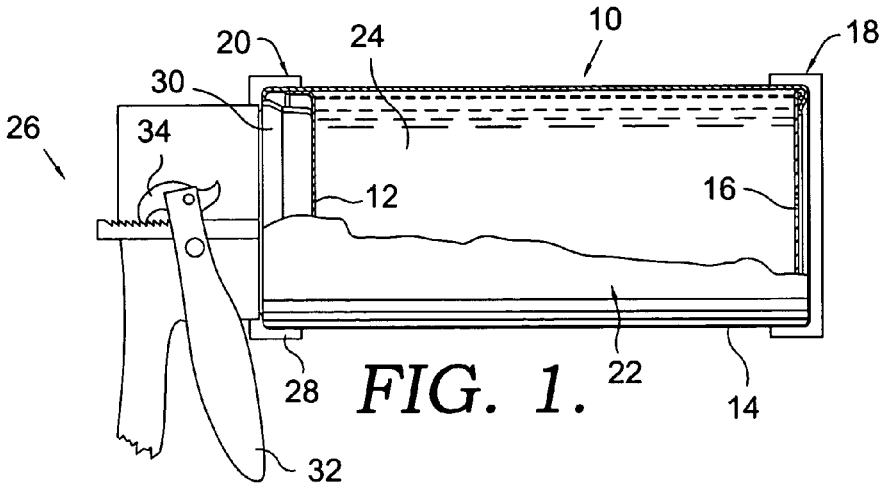
FIG. 1 is a side elevational view of an exemplary dispensing cartridge construction having a plug sealed therewith in accordance with one embodiment of the present invention, with the cartridge applied to a dispensing gun and shown partially in section.

A disposable food sauce cartridge dispenser 10 of the type utilizing the method of the present invention to seal a plug 12 therewith is shown in FIG. 1. The dispenser 10 is generally comprised of a cartridge body 14, an end disk 16 formed at a dispensing end 18 of the dispenser, and the plug 12 which is initially positioned at the plunging end 20 of the dispenser opposite of the dispensing end. A containment region 22 is defined within the cartridge body 14 between the plug 12 and the end disk 16 in which a volume of food sauce 24 is packaged and from which the food sauce may be dispensed through the end disk 16 by operation of a hand held dispensing gun 26. One exemplary arrangement for a dispensing gun 26 is shown, but forms no part of the present invention and is merely illustrated to show generically how the plug 12 may be advanced towards the end disk 16 to dispense food sauce 24. The manner in which the exemplary dispensing gun 26 operates is more fully disclosed in U.S. Pat. No. 4,432,473. The dispensing gun 26 is configured to receive the plunging end 20 of the dispenser 10 between a pair of flanged plates 28. The gun 26 includes a plunger 30 that fits against the plug 12 and may be advanced towards the dispensing end 18 by squeezing a trigger 32 that operates a ratchet mechanism 34. For each trigger squeezing cycle, the ratchet mechanism 34 advances the plunger 30—and thereby the plug 12—a pre-selected distance into the dispenser 10 based on the magnitude of the trigger squeeze, up to a set maximum, resulting in the dispensing out of valves (not shown) in the end disk 16 of a measured quantity of the food sauce 24.

Figure 2:
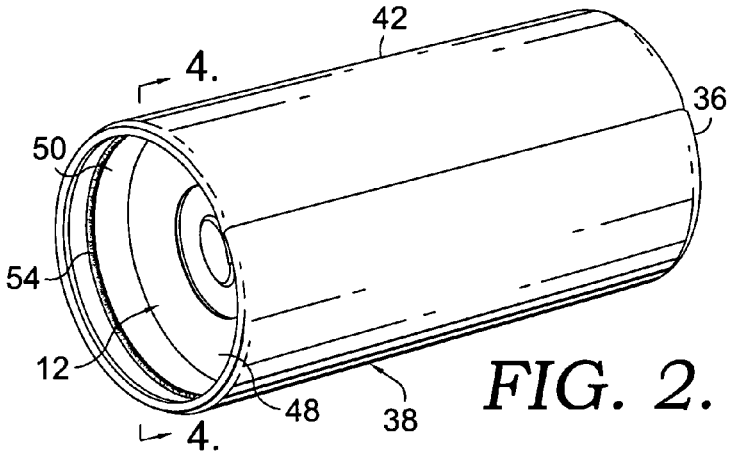
FIG. 2 is a perspective view showing the dispensing cartridge of FIG. 1.
Figure 3:
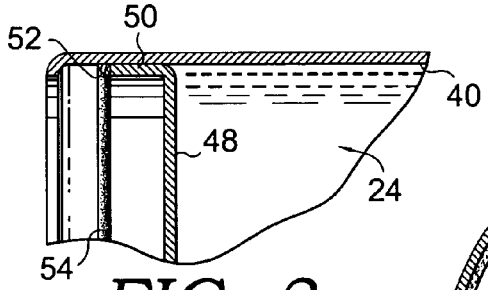
FIG. 3 is a fragmentary partial sectional view on an enlarged scale showing the relationship between disk, the adhesive and the cartridge body.

The plug 12 and cartridge body 14 are similar to those used in typical food sauce cartridge dispensers that are known in the art; however, the plug 12 has modifications that distinguish the plug from typical designs, as will be more fully explained herein. The configuration of the plug is best seen in FIGS. 2 and 3, and the construction of the cartridge body 14 is best seen in FIGS. 2 and 4.

The cartridge body 14 is preferably formed of paper stock with opposing ends 36 folded together in a continuous loop sidewall 38 such that the ends overlap one another and are adhered together (e.g., with adhesives) to form the cartridge body 14 in a cylindrical shape presenting an interior surface 40 and an exterior surface 42. The interior surface 40, and optionally the exterior surface 42, is typically coated with a thermoplastic liner. The section of the sidewall 38 where the ends 36 overlap is referred to as the overlap region 43. This overlap also forms an interior sideseam 44 and an exterior sideseam 46 that extend longitudinally along the sidewall parallel to a central longitudinal axis of the cartridge body 14.

The plug 12 has a body 48 that is generally disk-shaped with certain raised and depressed regions so that the plunger 30 of the dispensing gun 26 will better interface with the plug 12 and provide smooth dispensing operation. A peripheral skirt 50 extends generally perpendicularly from the body 48 and terminates at a smooth perimeter or circumferential edge 52. The skirt 50, or some portion therealong (e.g., circumferential edge 52), preferably has a diameter that is approximately the same as the average interior diameter of the cartridge body 14 so that the plug 12 may be loosely frictionally fit within the body prior to the plug being bonded with the interior surface 40. However, the plug diameter may be smaller or greater than the cartridge body 14 average interior diameter so long as there is not excessive friction between the plug 12 and the cartridge body interior surface 40 that would impede the desired operation of the dispensing gun 26. Plugs known in the art typically have an outer edge that tapers to a fine flange extending away from the body of the plug and having a much reduced thickness as compared to the thickness of the peripheral skirt. However, the smooth circumferential edge 52 of the plug 12 in the present invention presents a broader surface to which an adhesive 54 may be applied to bond the plug 12 with the cartridge body interior surface 40, as best seen in FIG. 3. Although the circumferential edge 52 is shown to be curved, it may also be formed at a right angle facing generally perpendicularly from the remaining portion of the peripheral skirt 50 and presenting a surface as broad as the thickness of the skirt.

Figure 4:
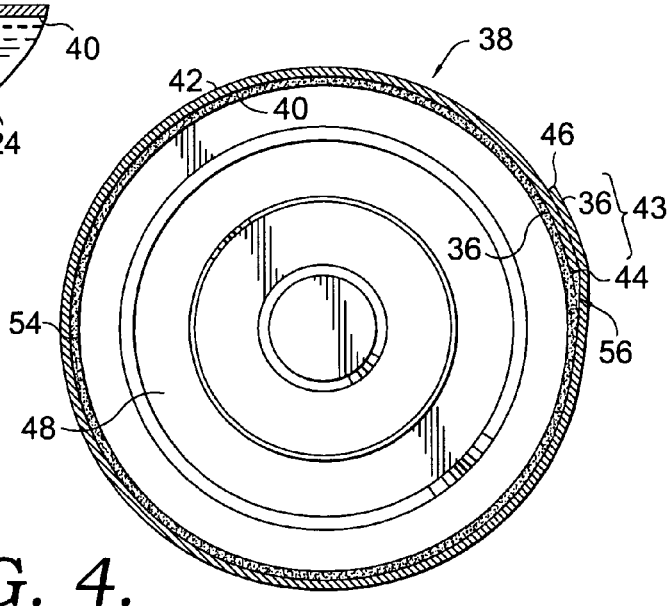
FIG. 4 is a cross-sectional view taken along line 4—4 showing the sideseam of the cartridge body and the gap filled by the adhesive.

As can be seen in FIG. 4, because of the interior sideseam 44, the interior diameter of the cartridge body 14 is not identical at all points. In the overlap region 43, the cartridge body 14 has a first diameter value that is generally consistent around a majority of the interior surface 40 of the body, and has a second diameter value larger than the first diameter value at a location proximal to the point where one of the overlapping ends 36 passes over and to the exterior of the other end 36 (i.e., laterally on the other side of the interior sideseam 44 from the overlap region 43). However, the plug 12 is generally circular and thus has a consistent diameter at least at some point on the peripheral skirt 50, preferably at least at the circumferential edge 52. Thus, when the plug 12 is placed in the cartridge body 14, the "step" in diameter created at the interior sideseam 44 forces the circumferential edge 52 radially inward at the location of measurement of the second diameter and forms a open channel or gap 56.

Thus, to assemble the cartridge dispenser 10, the first step is to position the plug 12 within the cartridge body 14 such that the circumferential edge 52 of the plug is aligned generally in a plane perpendicular or transverse to the central longitudinal axis of the body (i.e., perpendicular to the sidewall 38) and concentric with the interior surface 40, as seen in FIG. 4. At this point, the plug circumferential edge 52 is preferably immediately adjacent to the interior surface 40 for essentially the entire edge 52 so that the plug is not tilted relative to the cartridge body 14. The plug 12 is also preferably positioned initially near the dispensing end 18 of the dispenser 10 until it is later acted upon by the dispensing gun 26. Adhesive 54 is then applied to the circumferential edge 52 of the plug 12 to properly bond the plug 12 to the cartridge body interior surface 40 and to fill the gap 56 to prevent food sauce 24 from passing out of the containment region 22 around the plug 12. The adhesive 54 is preferably a food grade hot melt adhesive such as a thermoplastic adhesive, but may include other similar adhesives that include waxes, resins and plasticizers. The hot melt adhesive generates a bond with the thermoplastic liner formed on the interior surface 40 of the body 14 that is not so strong as to unreasonably inhibit the dispensing gun plunger 30 from advancing the plug 12 towards the dispensing end 18, but has sufficient strength and structural integrity as to not be deflected laterally from the interior surface 40 by food sauce pressing thereagainst when the plunger 30 is advanced and the pressure within the containment region 22 is increased. The adhesive 54 is preferably applied as a continuous bead around the circumferential edge 52, and may be applied sparingly directly into the gap 56 as well so long as the adhesive properly cures before running into the containment region 22 or has sufficient viscosity as to only travel a certain distance into the gap 56 short of region 22. After the adhesive 54 has properly cured, the cartridge dispenser 10 is ready for use in conjunction with a dispensing gun 26.

Preferably, the end disk 16 is secured to the cartridge body 14 before the plug 12 is bonded with the body. The end disk may be secured to the body 14 using known top crimping methods, or other methods known by those of skill in the art.

An alternative method of cartridge dispenser 10 assembly involves reversing the steps of plug 12 insertion and adhesive 54 application. Thus, the adhesive 54 (e.g., a food grade hot melt adhesive) may first be applied to the circumferential edge 52 of the plug 12, and then the plug 12 is quickly placed within the cartridge body 14 near the dispensing end 18 of the dispenser 10. The plug 12 should be aligned generally in a plane transverse to the central longitudinal axis of the cartridge body 14 and concentric with the interior surface 40, as seen in FIG. 4. For this method, the adhesive 54 should be of the type that does not cure instantly upon application to the plug 12, but gives sufficient time for insertion and proper alignment of the plug 12 within the cartridge body 14 before bonding with the body interior surface 40. Also, either sufficient adhesive 54 should be applied to the plug circumferential edge 52 so that gap 56 will be covered once the plug 12 is properly positioned in the cartridge body 14, or extra adhesive 54 may be applied directly over the gap 56 once the plug 12 is set in place.

Since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A method of bonding a plug to an interior surface of a cartridge body formed of a continuous loop sidewall, the cartridge body combining with the plug and an end disk spaced from the plug to form a dispenser cartridge used to hold and dispense food sauce, a containment region for the dispenser cartridge defined between the plug and the end disk and bounded by the cartridge body, the method comprising the steps of:

positioning the plug having a body with a terminal perimeter edge within the cartridge body at an orientation such that the thermal perimeter edge is immediately adjacent to the interior surface of the cartridge body; and applying a layer of hot melt adhesive to the terminal perimeter edge of the plug on the outside of the containment region of food sauce to seal the plug with the cartridge body interior surface and prevent food sauce disposed within the containment region from exiting the region by flowing around the terminal perimeter edge of the plug along the cartridge body interior surface.

2. The method of claim 1, wherein the cartridge body is generally cylindrical in shape and the step of positioning the plug comprises positioning the plug within the cartridge body at an orientation such that the terminal perimeter edge of the plug is generally concentric with the cartridge body interior surface.

3. The method of claim 1, wherein the diameter of the plug defined at the terminal perimeter edge is approximately the same as the interior diameter of the cartridge body for a substantial circumferential distance around the cartridge body interior surface.

4. The method of claim 1, wherein interior surface of the cartridge body has a longitudinal sideseam extending the length of the body to present a first interior diameter of the cartridge body measured from a first position immediately lateral of the sideseam and a second interior diameter of the cartridge body measured from a second position immediately lateral of the sideseam on an opposite side of the sideseam from the first interior diameter, the first interior diameter being larger than the second interior diameter, and wherein the step of positioning the plug comprises positioning the plug within the cartridge body with a gap formed between the terminal perimeter edge of the plug and the interior surface of the cartridge body at the first position, and wherein the step of applying a layer of hot melt adhesive further comprises applying the adhesive to the terminal perimeter edge of the plug such that the adhesive covers the gap.

5. The method of claim 1, wherein the hot melt adhesive is a thermoplastic food grade adhesive.

6. The method of claim 1, wherein the plug further comprises a peripheral skirt extending generally perpendicularly from the body and terminating at the terminal perimeter edge, the terminal perimeter edge presenting a smooth interface surface to which the hot melt adhesive is applied.

7. In a method of constructing a dispenser cartridge used to hold and dispense food sauce, the dispenser cartridge formed of a generally cylindrical cartridge body having a central longitudinal axis, an end disk affixed to a dispenser end of the cartridge body, and plug positioned within the cartridge body and spaced from the end disk, where the cylindrical cartridge body is formed by looping opposing ends of a planar sheet together in overlapping relation and affixing the ends to each other to form the cartridge body with an interior surface where a longitudinal sideseam extends thereon for the length of the cartridge body, the improvement comprising the steps of:

aligning the plug such that a circumferential edge thereof is transversely aligned with respect to the cartridge body central longitudinal axis; and applying a layer of hot melt adhesive to the circumferential edge of the plug on the outside of the containment region of food sauce to seal the plug with the cartridge body interior surface such that any food sauce disposed within the cartridge body and between the end disk and the plug is prevented from flowing past the circumferential edge of the plug along the cartridge body interior surface.

8. The method of claim 7, wherein the adhesive is a thermoplastic food grade hot melt adhesive.

9. The method of claim 7, wherein the plug further comprises a body and a peripheral skirt extending from the body on which the circumferential edge is formed, and wherein the step of applying a layer of adhesive further comprises applying the adhesive into a gap formed between the peripheral skirt and the interior surface of the cartridge body proximal to the sideseam.

10. A method of coupling a plug to a generally cylindrical cartridge body for a dispenser cartridge used to hold and dispense food sauce, the cartridge body formed of a continuous loop sidewall presenting an interior surface, the method comprising the steps of:

positioning the plug having a circumferential edge within the cartridge body such that the circumferential edge is aligned generally in a plane transverse to the interior surface of the cartridge body; and applying a layer of hot melt adhesive to the circumferential edge of the plug on the outside of the containment region of food sauce to seal the plug with the cartridge body and serve as a barrier to flow of food sauce disposed within the cartridge past the circumferential edge of the plug along the cartridge body interior surface.

11. The method of claim 10, wherein a sides earn extends longitudinally along the cartridge body interior surface formed by overlapping portions of the continuous loop sidewall to present a first interior diameter of the cartridge body measured from a first position immediately adjacent to the overlapping portions, and a second interior diameter of the cartridge body measured from a second position collocated with the overlapping portions, the first interior diameter being larger than the second interior diameter, and wherein the step of positioning the plug comprises positioning the plug within the cartridge body with a gap formed between the circumferential edge of the plug and the interior surface of the cartridge body at the first position, and wherein the step of applying a layer of hot melt adhesive further comprises applying the adhesive to the terminal perimeter edge of the plug such that the adhesive covers the gap.

12. A method of bonding a plug to an interior surface of a cartridge body formed of a continuous loop sidewall, the cartridge body combining with the plug and an end disk spaced from the plug to form a dispenser cartridge used to hold and dispense food sauce, a containment region for the dispenser cartridge defined between the plug and the end disk and bounded by the cartridge body, the method comprising the steps of:

applying a layer of hot melt adhesive to the circumferential edge of a plug; and positioning the plug within the cartridge body at an orientation such that the circumferential edge is aligned generally in a plane transverse to the interior surface of the cartridge body, and such that the layer of hot melt adhesive is on the outside of the containment region of food sauce whereby the adhesive seals the plug with the cartridge body interior surface and prevents food sauce disposed within the containment region from exiting the region by flowing around the circumferential edge of the plug along the cartridge body interior surface.

* * * * *

UNITED STATES PATENT AND TRADEMARK OFFICE

CERTIFICATE OF CORRECTION

PATENT NO. : 7,146,782 B2
APPLICATION NO. : 10/643658
DATED : December 12, 2006
INVENTOR(S) : Joseph A. Pantelleria et al.

It is certified that error appears in the above-identified patent and that said Letters Patent is hereby corrected as shown below:

In Claim 1, Column 5, line 42, the word "thermal" should be replaced with the word --terminal.--

Signed and Sealed this

Twenty-seventh Day of February, 2007

JON W. DUDAS
*Director of the United States Patent and Trademark Office*